US006261615B1

(12) United States Patent
Sumpmann et al.

(10) Patent No.: US 6,261,615 B1
(45) Date of Patent: Jul. 17, 2001

(54) CANISTER WITH VENTING HOLES FOR CONTAINING A PARTICULATE-TYPE PRODUCT

(75) Inventors: Patrick J. Sumpmann; Curtis J. Deering, both of Maple Grove; Sarah J. Moberg, Minneapolis; William E. Archibald, Maple Grove, all of MN (US)

(73) Assignee: General Mills, Inc., Minneapolis, MN (US)

( * ) Notice: Subject to any disclaimer, the term of this patent is extended or adjusted under 35 U.S.C. 154(b) by 0 days.

(21) Appl. No.: 09/346,440

(22) Filed: Jul. 1, 1999

(51) Int. Cl.[7] ..... B65D 6/08; B65D 8/02

(52) U.S. Cl. ..... 426/106; 426/392; 220/676

(58) Field of Search ..... 426/106, 118, 426/131, 392, 395, 397, 404, 415, 419; 220/676; 383/102, 103; 292/120

(56) References Cited

U.S. PATENT DOCUMENTS

| | | | | |
|---|---|---|---|---|
| D. 266,049 | * | 9/1982 | Costi | D7/76 |
| D. 269,361 | * | 6/1983 | Marschak | D21/121 |
| 2,889,976 | | 6/1959 | Van Cantfort | 229/125.11 |
| 3,768,719 | * | 10/1973 | Jonhson | 229/14 B |
| 4,310,118 | * | 1/1982 | Kisida et al. | 229/62.5 |
| 4,459,793 | | 7/1984 | Zenger | 53/434 |
| 4,466,553 | | 8/1984 | Zenger | 220/461 |
| 4,498,581 | | 2/1985 | Dutcher | 206/427 |
| 4,672,684 | * | 6/1987 | Barnes et al. | 383/45 |
| 4,743,123 | * | 5/1988 | Legters et al. | 383/103 |
| 4,768,703 | | 9/1988 | Sosler et al. | 229/123.1 |
| 4,890,761 | | 1/1990 | Gaves | 220/404 |
| 5,108,669 | * | 4/1992 | Van Dijk et al. | 264/25 |
| 5,405,561 | * | 4/1995 | Dias et al. | 264/40.1 |
| 5,492,705 | * | 2/1996 | Porchia et al. | 426/106 |
| 5,566,529 | | 10/1996 | Sireix | 53/412 |
| 5,688,544 | * | 11/1997 | Bolton et al. | 426/118 |
| 5,727,819 | | 3/1998 | Grosskopf et al. | 283/81 |
| 5,730,306 | * | 3/1998 | Costa et al. | 215/261 |
| 5,778,639 | | 7/1998 | Sireix | 53/432 |

FOREIGN PATENT DOCUMENTS

99/30974 6/1999 (WO) .

OTHER PUBLICATIONS

S Sacharow & R. Griffin, Jr., Food Packaging, Chapter 1, Packaging Evolution, p. 13, 1970.*

Three–Dimensional Pioneer® Baking Mix packaging as shown in five photographs depicting different views, Copyright 1996 Pioneer Flour Mills.

* cited by examiner

*Primary Examiner*—Milton Cano
*Assistant Examiner*—Sherry A. Dauerman
(74) *Attorney, Agent, or Firm*—John A. O'Toole; Douglas J. Taylor; Timothy A. Czaja

(57) ABSTRACT

A canister for containing a particulate-type product. The canister includes a canister body and a plurality of microholes formed in the canister body. Other than the plurality of microholes, the canister body is hermetically sealed. In this regard, the canister body defines an internal storage region configured to contain a particulate-type product. The plurality of microholes are sized to allow passage of air from the internal storage region, as well as to limit passage of the particulate-type product. During use, a decrease in atmospheric pressure applied to the canister, such as during shipping, results in air being vented from the internal storage region via the plurality of microholes. Due to this air flow, an internal pressure of the canister body maintains substantial equilibrium with atmospheric pressure such that the canister body will not expand.

43 Claims, 4 Drawing Sheets

CANISTER WITH VENTING HOLES FOR CONTAINING A PARTICULATE-TYPE PRODUCT

CROSS REFERENCE TO RELATED APPLICATIONS

This application is related to U.S. patent application Ser. No. 29/106,130 pending, entitled "Canister For A Particulate-Type Product" filed on Jun. 9, 1999, assigned to the same assignee, and incorporated by reference thereto. In addition, this application is related to U.S. patent application Ser. No. 09/346,189 pending, entitled "Double Cut Seal Membrane For A Canister Containing A Particulate-Type Product"; to U.S. patent application Ser. No. 09/346,443 pending, entitled "Perforated Air-Tight Seal Membrane For A Canister Containing A Particulate-Type Product"; and to U.S. patent application Ser. No. 09/346,441 pending, entitled "Canister With Adhered Paper Layers For A Particulate-Type Product", all filed on even date herewith, assigned to the same assignee, and incorporated by reference thereto.

BACKGROUND OF THE INVENTION

The present invention relates to a canister for containing a particulate-type product. More particularly, it relates to a canister having venting holes for containing a particulate-type product, such as a ready-to-eat cereal, the venting holes facilitating pressure equilibrium at high altitudes.

An extremely popular form of packaging for dry, particulate-type products sold to consumers is a paper carton. The paper carton normally is rectangular in shape, constructed of one or more layers of paper, and may or may not include an additional plastic liner. A wide variety of products are packaged in this form, ranging from consumable items such as cereals and baking goods, to non-consumable items such as laundry detergents and de-icing salt pellets. Paper cartons present a number of advantages for manufacturers, retailers and consumers. For example, paper cartons are relatively inexpensive to manufacture and provide a number of flat surfaces onto which product or promotional information can be displayed. Due to the rectangular shape, cartons are readily stackable. Thus, a retailer can maximize shelf space while fully displaying the product. Consumers likewise find the stackability characteristic desirable for home storage. Finally, paper cartons are typically sized in accordance with consumer preferences such that a desired amount or volume of product is provided with each individual carton.

Certain types of products are amenable to storage within a paper carton alone. Generally speaking, however, a paper carton cannot, in and of itself, adequately maintain product integrity. For example, a paper carton likely will not prevent aroma, moisture, contaminants, small insects, etc. from passing through to the contained product. Thus, packaging for virtually all particulate-type products requires an additional container or liner disposed within the paper carton. This is especially true for consumable/food products. A widely accepted technique for maintaining product integrity is to place the product into an inner container or bag, that in turn is stored in the carton (commonly referred to as a "bag in a box"). The bag is typically made of a plastic or glassine material and is, in theory, sealed about the product. In this sealed form, the bag maintains product freshness and provides protection against insect infestation, whereas the outer paper carton provides packaging strength and display. Alternatively, a double packaging machine (DPM) technique may be employed to form a plastic or glassine liner within a paper carton. Regardless of the exact manufacturing process, the resulting packaging configuration includes a box with an inner liner that serves as a barrier material. For virtually all applications, a large volume of air will be "contained" within the inner liner in addition to the particulate-type product. That is to say, the particulate-type product will not encompass the entire internal volume of the inner liner, and may include spacing between individual product particles.

As described above, a concerted attempt is made to hermetically seal the inner liner about the particulate-type product. On a mass production basis, however, current packaging technology cannot consistently meet this goal. For example, small openings may remain at an apex of two inner liner film sheets joined to one another. In short, manufacturers accept the fact that some leakage will occur into and out of the inner liner through one or more small openings. Although unexpected, these openings normally are not large enough for passage of contaminants or discharge of product. In fact, the openings may provide a benefit during shipping. Packaged product is typically shipped via truck from the manufacturer to retailers at various locations. The location (e.g., city or town) of a particular retailer often is at a greater altitude than that of the manufacturer, or the route traveled by the truck may include a relatively drastic change in altitude. With increasing altitude, the atmospheric pressure exerted on the carton decreases. Because the carton/inner liner is not hermetically sealed, the pressure differential causes air to vent from the inner liner, thereby bringing an internal pressure of the packaging into equilibrium with the now lower atmospheric pressure. Were the inner liner hermetically sealed, this release of air could not occur, resulting in expansion of the inner liner. This expansion may damage the inner liner/carton. For example, the carton wall(s) may bow, reducing the carton's compression strength (both longitudinal and side-to-side) such that the carton is more susceptible to crushing under typically-encountered forces. Additionally, where a quantity of cartons are closely packed within a corrugated shipping container, expansion of the inner liners may cause the cartons to tightly lodge against one another, rendering removal of the packages from the shipping container extremely difficult.

From a manufacturer's standpoint, box with an inner liner packaging satisfies a number of important criteria including low cost, stackability, and large, flat surfaces for displaying product and promotional information. Unfortunately, however, consumers may encounter several potential drawbacks. These possible disadvantages are perhaps best illustrated by reference to a ready-to-eat cereal product, although it should be understood that a wide variety of other products are similarly packaged.

Most ready-to-eat cereal products are sold to consumers with the box with an inner liner packaging format. To consume the cereal, the user must first open the paper carton. In this regard, a top portion of the carton typically forms at least two flaps folded on top of one another. The flaps are initially at least partially adhered to one another with an adhesive. By pulling or otherwise tearing one flap away from the other, a consumer can then access the inner bag. An all too common problem is that the selected adhesive creates too strong of a bond between the flaps, making flap separation exceedingly difficult.

Once the carton has been opened, the consumer must then open the inner bag. Once again, this may be a cumbersome procedure. More particularly, an elongated seal is typically formed and extends along a top portion of the bag. This seal is broken (or "opened") by pulling apart opposite sides of the bag. In some instances, the so-formed seal is too rigid for simple opening. Even further, a person with reduced dexterity and strength, such as a child or elderly individual, may have difficulty in breaking an even relatively light seal. As a result, attempts at opening the inner bag or liner often result in an undesirable tear along a side of the bag, causing unacceptable product displacement from the bag, or an uneven opening. The consumer may resort to using a knife or scissors, possibly resulting in bodily harm.

Once the carton and bag or liner has been opened, the consumer is then ready to pour the contents from the package. Due to the flexible nature of the inner bag, the actual opening through which the product flows is unpredictable. That is to say, the opening formed in the bag is not uniform or fixed. As a result, a larger than expected volume of product may unexpectedly pour from the container. Alternatively, where the inner bag has not been properly opened, product flow may be unacceptably slow. Further, an inherent bias or bend typically causes the flaps to extend upwardly relative to a top of the carton. Thus, the flaps will impede a user from visually confirming acceptable product volume and flow. Additionally, the inner bag typically is not secured to the carton. During a subsequent pouring operation, then, the entire bag may undesirably release from the carton.

A further consumer concern relating to box with an inner liner packaging stems from attempts to reclose the package for subsequent storage of remaining product. Again with reference to widely employed ready-to-eat cereal packaging, following dispensing of a portion of the cereal from the package, the user is then required to roll or fold the top portion of the bag or liner over onto itself so as to "close" the bag. It is not uncommon for a user to simply forget to perform this operation. Alternatively, even where an attempt is made, the bag cannot be resealed and thus remains at least partially open. Similarly, the bag may subsequently unroll. Individual cereal pieces may be undesirably released from the bag and/or contaminants can enter into the bag. Regardless, a reclosure feature normally associated with the carton normally does not provide an effective barrier to unexpected product displacement and/or contamination due to removal, poor design, misuse, lack of use, etc. These concerns are exacerbated when attempting to store a previously-opened package on its side or when the package is accidentally dropped. In either case, because neither the carton nor the bag provides a complete closure, unanticipated release of cereal from the container may occur.

Viewed as a whole, concerns relating to standard box with an inner liner packaging present numerous opportunities for consumer dissatisfaction. Essentially, consumer preferences for improvements to particulate-type product packaging can be separated into four categories. Consumers prefer that the package be easy to open, easily and satisfactorily reclosed, facilitate consistent and easy pouring and is acceptable for "clean" use by a child or others with limited dexterity. Obviously, consumers further prefer that product costs be as low as possible, and that certain other beneficial attributes associated with the existing box with inner liner packaging continue to be implemented. These existing properties include package strength, product damage protection, use of high volume commercially available materials, visual display of product and promotional material, recycleability, stackability, and moisture, aroma, contaminant and insect protection.

Certain other packaging schemes are available that address, at least in part, several of the above-listed consumer preferences. Unfortunately, however, these packaging techniques entail other drawbacks, thereby limiting their usefulness. For example, rigid plastic containers having removable, sealable lids are available. The greatly increased costs associated with this packaging configuration prohibit its implementation on a mass production basis. Similarly, it may be possible to provide the inner bag with a "zip-lock" sealing feature. While this technique may alleviate several of the reclosure issues previously described, the zip-lock design is expensive and often times does not provide a complete seal. Importantly, with these and other envisioned packaging schemes, consistent formation of a hermetic seal will result in the above-described expansion concerns when the package is shipped to a high altitude location. Once again, because the package technique does not account for necessary venting, an increase in altitude may cause problematic package expansion.

Consumers continue to express a high demand for particulate-type products sold in a paper cartons. However, various problems associated with use of standard packaging, and in particular box with an inner liner packages, may diminish purchasing enthusiasm. Alternative packaging designs may satisfy some consumer concerns, but in fact create new problems, such as deleterious package expansion during shipment to higher altitude locations. Therefore, a need exists for a particulate-type product canister configured to address consumer use preferences while providing adequate venting upon shipment to high elevations.

SUMMARY OF THE INVENTION

One aspect of the present invention provides a canister for containing a particulate-type product. The canister includes a canister body and a plurality of microholes formed in the canister body. The canister body defines an internal storage region. The plurality of microholes formed in the canister body are sized for allowing air flow from the internal storage region, while limiting passage of particulate-type product from the internal storage region. With this configuration, other than the plurality of microholes, the canister body is substantially hermetically sealed. As the canister is physically moved from a low altitude to a high altitude, atmospheric pressure acting upon the canister body decreases. The plurality of microholes compensate for this decrease in atmospheric pressure by allowing a sufficient volume of air to vent from the internal storage region. Thus, an internal pressure of the canister body remains in substantial equilibrium with atmospheric pressure such that the canister body does not overly expand. In one preferred embodiment, the canister is configured to maintain a food product such as a ready-to-eat cereal.

Another aspect of the present invention relates to a packaged good article comprising a canister and a particulate-type product. The canister includes a canister body and a plurality of microholes formed in the canister body. The canister body defines an internal storage region. The plurality of microholes are configured to allow air flow from the internal storage region. Other than the plurality of microholes, the canister body is substantially hermetically sealed. The particulate-type product is disposed within the internal storage region. With this in mind, each of the plurality of microholes are sized to limit, preferably prevent, release of the particulate-type product from the internal storage region. In one preferred embodiment, the particulate-type product is a dry, ready-to-eat cereal.

Yet another aspect of the present invention relates to a method of manufacturing a packaged good article. The method includes forming a hermetically sealable canister having an internal storage region. A plurality of microholes are imparted into the canister, extending from an exterior of the canister to the internal storage region. The internal storage region is then partially filled with a particulate-type product. A majority of the remaining volume of the internal storage region not otherwise occupied by the particulate-type product is filled with air. This air within the internal storage region imparts an internal pressure onto the canister. Upon a decrease in atmospheric pressure acting upon the canister, the plurality of microholes allow venting of a sufficient of air from the internal storage region to equilibrate the internal pressure with atmospheric pressure. In one preferred embodiment, the internal storage region is partially filled with a ready-to-eat cereal.

DETAILED DESCRIPTION OF THE PREFERRED EMBODIMENTS

Figure 1:
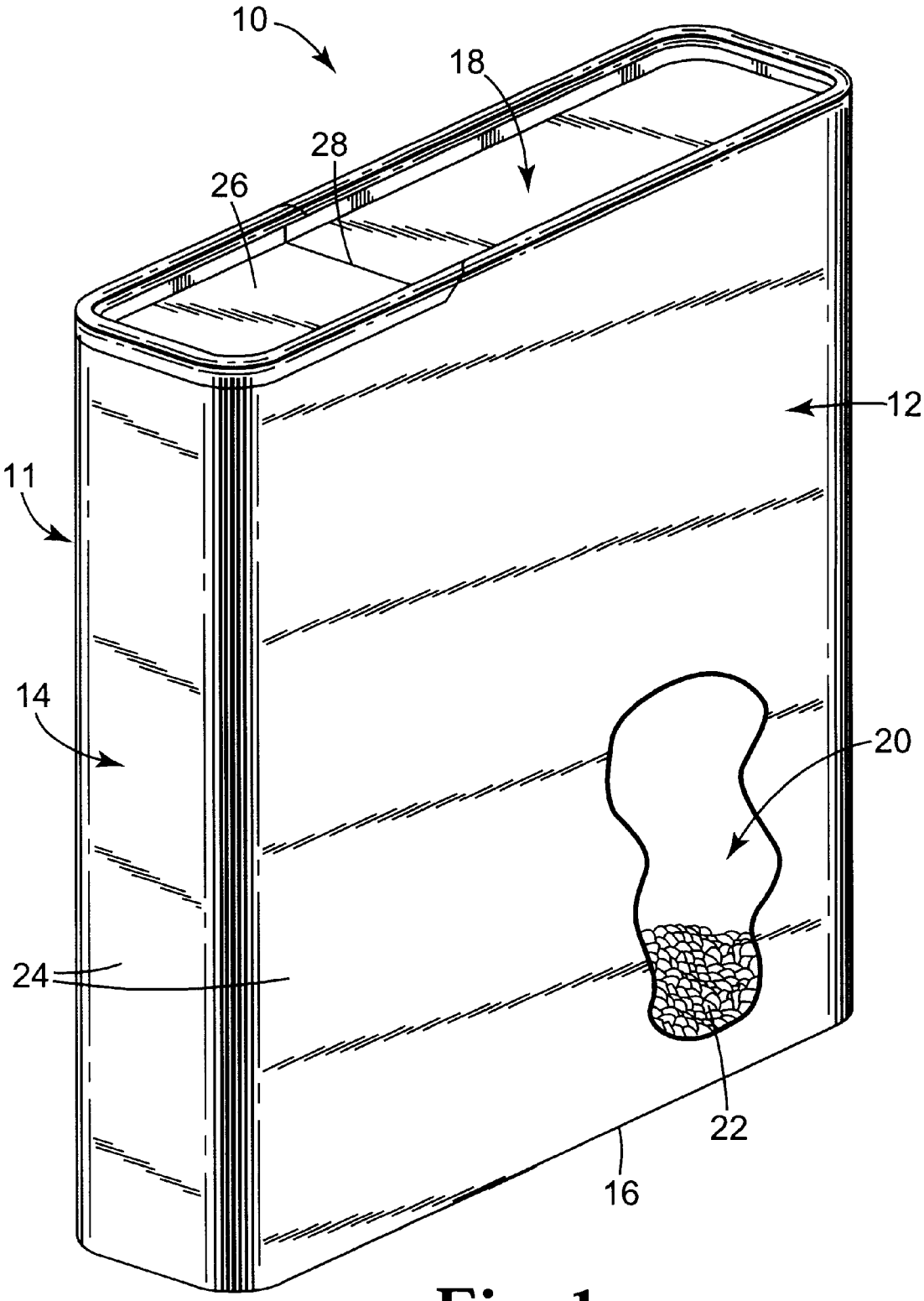
FIG. 1 is a perspective view of a canister in accordance with the present invention with a portion cut away.

One preferred embodiment of a canister 10 is shown in FIG. 1. The canister 10 is comprised of a canister body 11 that preferably includes opposing face panels 12 (one of which is shown in FIG. 1), opposing side panels 14 (one of which is shown in FIG. 1), a bottom panel or closure 16 (shown partially in FIG. 1) and a top panel or closure 18. As described in greater detail below, the opposing face panels 12 and the opposing side panels 14 are connected to one another. The bottom panel 16 is connected to the opposing face panels 12 and the opposing side panels 14 at a lower portion thereof. Similarly, the top panel 18 is connected to the opposing face panels 12 and the opposing side panels 14 at an upper portion thereof. This configuration provides for an internal storage region 20 (shown partially in FIG. 1), within which a particulate-type product 22 is disposed, and an outer surface 24 onto which product or promotional information can be displayed. Notably, directional terminology such as "bottom," "top," "upper" and "lower" is used for purposes of illustration and with reference to a desired upright orientation of the canister 10 as shown in FIG. 1. However, the canister body 11 can be positioned in other orientations such that the directional terminology is in no way limiting.

Each of the panels 12–18 is preferably formed from a paper and plastic material. For example, in one preferred embodiment, a layer of plastic is adhered or laminated to a layer of paper (such as label stock or paperboard) to form each of the panels 12–18. Multiple layers of plastic and/or paper can also be employed. Alternatively, a plastic material or resin can be intertwined with the fibers of a paper material. The combination of paper and plastic materials preferably recyclable and provides a functional barrier to various contaminants, such as flavor, aroma, moisture, oil, grease, other contaminants, insects, etc. Further, the selected plastic must be suitable for contact with the particulate-product 22. For example, where the particulate-type product 22 is a food product, the selected plastic material must be approved for food contact, as is well known in the art. Thus, for example, the plastic material can be polyethylene (low density or high density), chlorinated plastic, ethylene vinyl acetate, polyester, nylon, polypropylene, etc. Even further, the plastic can be various co-polymers, blends or a combination of plastic materials.

By forming the panels 12–18 from a combination of paper and plastic or other sealable materials, the resulting canister 10 is hermetically sealable. In other words, upon final construction, the internal storage region 20 is sealed about the particulate-type product 22. Notably, the same result can be accomplished with other manufacturing techniques, such as by incorporating a separate plastic liner that is hermetically sealed. Additionally, additional materials may be employed to ensure a hermetic seal. For example, in one preferred embodiment, the top panel 18 is configured to form a hinged lid 26 that is pivotable along a score line 28 to provide access to the particulate-type product 22. With this construction, an additional plastic membrane (not shown) is sealed to the canister body 11 below the lid 26 to ensure an air tight seal. Alternatively, a hermetically sealable characteristic can be achieved by shapes other than a rectangular cylinder. Thus, the canister body 11 can assume a wide variety of other configurations including circular, triangular, etc. Further, the bottom panel 16 and the top panel 18 can be eliminated such that the canister body 11 is hermetically sealed by simply sealing closed the opposing face panels 12 and the opposing end panels 14 at upper and lower portions thereof.

The sealable nature of the canister 10 facilitates its use in containing a wide variety of particulate-type products. For example, the particulate-type product 22 can be a food product, and in particular a dry food product. One specific category of available food products is cereal-based products (e.g., formed from wheat, oats, rice, etc.). These include ready-to-eat cereals such as puffs, flakes, shreds and combinations thereof. Further, the ready-to-eat cereal product can include other ingredients such as dried fruits, nuts, dried marshmallows, sugar coatings, etc. Alternatively, other particulate-type dry food products can be maintained by the canister 10, such as, for example, popcorn (popped or unpopped), dried pasta (e.g., spaghetti noodles), rice, beans, pretzels, potato chips, sugar, flour, dried milk, etc. Even further, other consumable items such as birdseed can be used as the particulate-type product 22. Yet even further, non-consumable particulate-type products can be contained including fertilizer pellets, dry laundry detergent, dry dish-washing detergent, plant or vegetable seeds, de-icing salt pellets, etc. Regardless of the exact product selected for the particulate-type product 22, the sealable nature of the canister 10 maintains integrity of the product 22.

Figure 2:
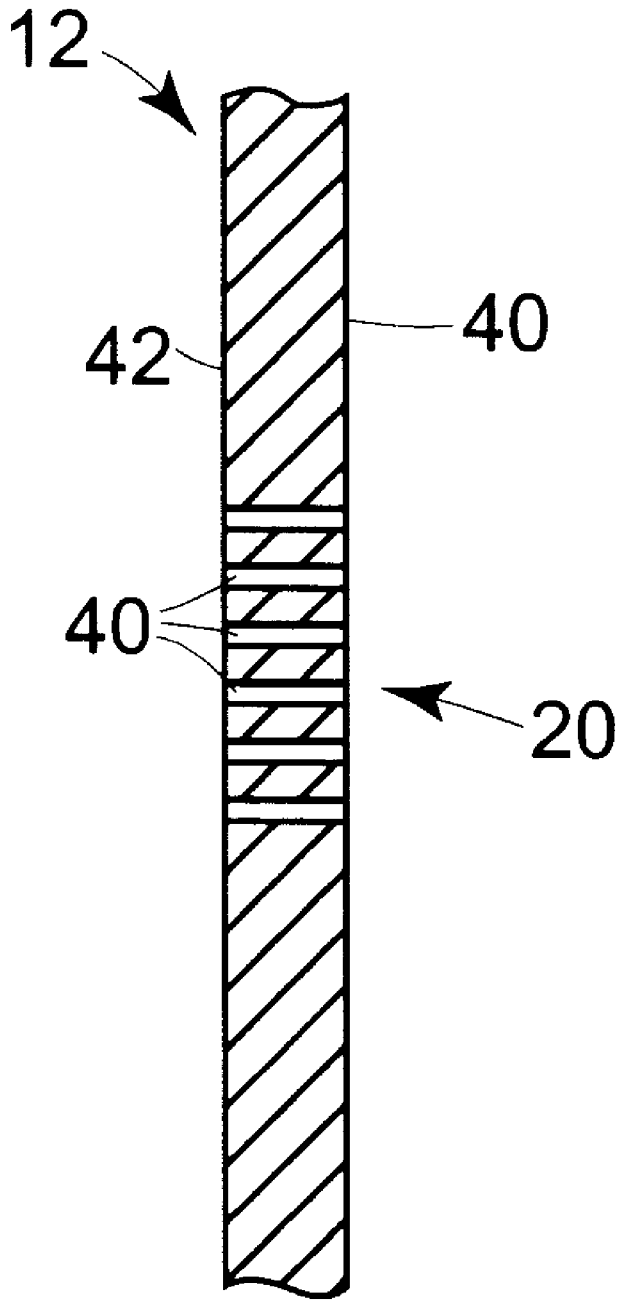
FIG. 2 is an enlarged, cross-sectional view of a portion of the canister of FIG. 1.

Due to the hermetically sealable nature of the canister 10, a plurality of microholes 40 are imparted into at least one of the panels 12–18 as shown in FIG. 2. As a point of reference, the plurality of microholes 40 is shown in FIG. 2 as extending through one of the opposing face panels 12. It should be understood, however, that the plurality of microholes 40 may be formed in both of the opposing face panels 12, one or more of the opposing side panels 14 (FIG. 1), the bottom panel 16 (FIG. 1) and/or the top panel 18 (FIG. 1). Regardless, the face panel 12 is shown in FIG. 2 as defining an outer surface 42 and an inner surface 44. The outer surface 42 of the face panel 12 corresponds with the outer surface 24 of the canister body 11 shown in FIG. 1. Conversely, the inner surface 44 corresponds with an innermost surface of the canister body 11 (i.e., defining the internal storage region 20 shown generally in FIG. 2). Each of the plurality of microholes 40 extends between the outer surface 42 and the inner surface 44. With this configuration, the plurality of microholes 40 provides for fluid communication between the internal storage region 20 and the atmosphere surrounding the panel 12 (and thus the canister body 11). Thus, the plurality of microholes 40 allow for air flow into and out of the internal storage region 20 that is otherwise hermetically sealed by the canister body 11. Notably, where the canister 10 is constructed to include an additional plastic liner or other structure that hermetically seals the internal storage region 20, the plurality of microholes 40 will extend through that additional structure.

In a preferred embodiment, each of the plurality of microholes 40 are uniformly formed, having a diameter in the range of approximately 10–100 micrometers; more preferably 60–80 micrometers; most preferably 70 micrometers. Experiments have revealed that insects and other potential contaminants, such as moisture, cannot pass through holes with diameters less 100 micrometers. Thus, even with the formation of the plurality of microholes 40, the face panel 12, and any other of the panels 12–18 (FIG. 1) through which microholes are imparted, will continue to serve as a contaminant barrier. Similarly, microhole diameters of less than 100 micrometers are sufficiently small so as to prevent passage of the particulate-type product 22 (FIG. 1) from the internal storage region 20. In this regard, most particulate-type products sold to consumers include individual particles having diameters or widths well in excess of 5 millimeters and therefore will not release from the internal storage region 20 via the plurality of microholes 40. It is recognized that for many products, and in particular food products, individual particles may periodically break or partially disintegrate. For example, a ready-to-eat cereal product may include individual flakes coated with sugar. During handling, portions of the sugar coating may break away from the individual flakes, resulting in an even smaller particle. Experiments have shown that a microhole having a diameter of less than 100 micrometers will not allow passage of these reduced-sized particles. In fact, experiments conducted with canisters containing flour have revealed that individual flour particles will not be released through microholes that are 70 micrometers in diameter.

Conversely, a microhole diameter greater than approximately 10 micrometers is sufficiently large to allow passage of air. Thus, as described in greater detail below, air flow into and out of the internal storage region 20 is facilitated by the plurality of microholes 40 each having a diameter of at least approximately 10 micrometers.

A final concern relating to a preferred diameter of the plurality of microholes 40 relates to consistent, cost effective mass production. As should be apparent from the above, it is preferable to form the plurality of microholes 40 as small as possible so as to limit passage of contaminants and undesired release of product. While a variety of techniques are available for generating microholes, such as with a YAG or carbon dioxide laser, effective large scale production requires relatively rapid formation of a number of microholes. With this in mind, currently available technology can consistently form 70 micrometer holes on a high-speed packaging line. Thus, in the preferred embodiment, each of the plurality of microholes 40 has a diameter of approximately 70 micrometers.

Figure 3:
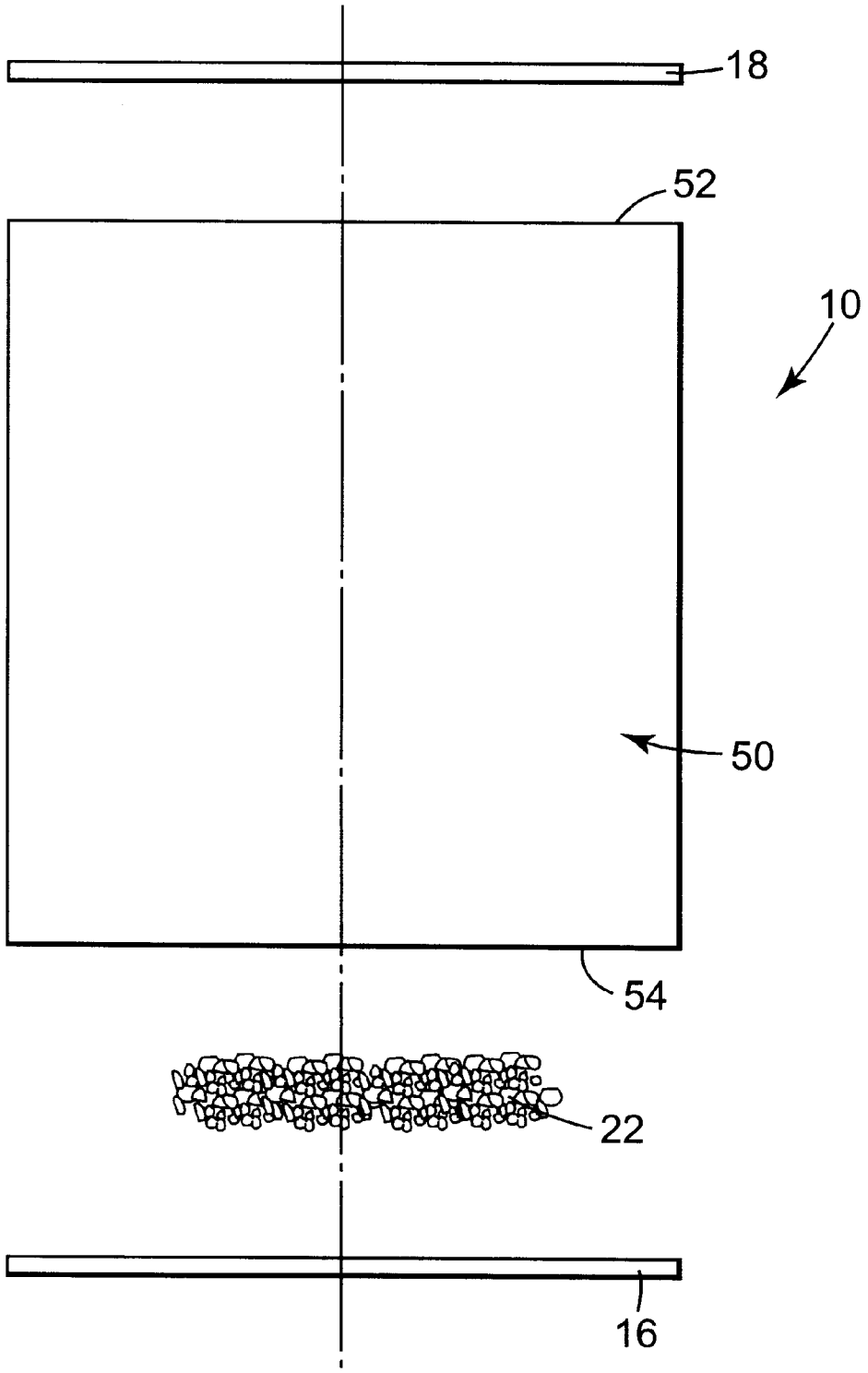
FIG. 3 is an exploded view of the canister of FIG. 1.

One preferred method of manufacturing the canister 10 is best described with reference to FIG. 3. The opposing face panels 12 and the opposing side panels 14 are connected so as to define a tubular body 50 having an upper opening 52 (shown partially in FIG. 3) and a lower opening 54 (shown partially in FIG. 3). In this regard, the opposing face panels 12 and the opposing side panels 14 are preferably integrally formed, such as by wrapping a sheet of preformed material about an appropriately shaped mandrel (not shown). Opposing edges of the sheet are sealed to form the tubular body 50. Alternatively, the opposing face panels 12 and the opposing side panels 14 can be separately formed, and subsequently connected to one another. The top panel 18 is then connected to the tubular body 50 so as to encompass the upper opening 52. Alternatively, the upper opening 52 can simply be sealed closed. The particulate-type product 22 is then placed within the internal storage region 20 (FIG. 1) defined by the tubular body 50. Finally, the bottom panel 16 is connected to the tubular body 50 so as to encompass the lower opening 54. Alternatively, the lower opening 54 can simply be sealed closed.

Figure 4:
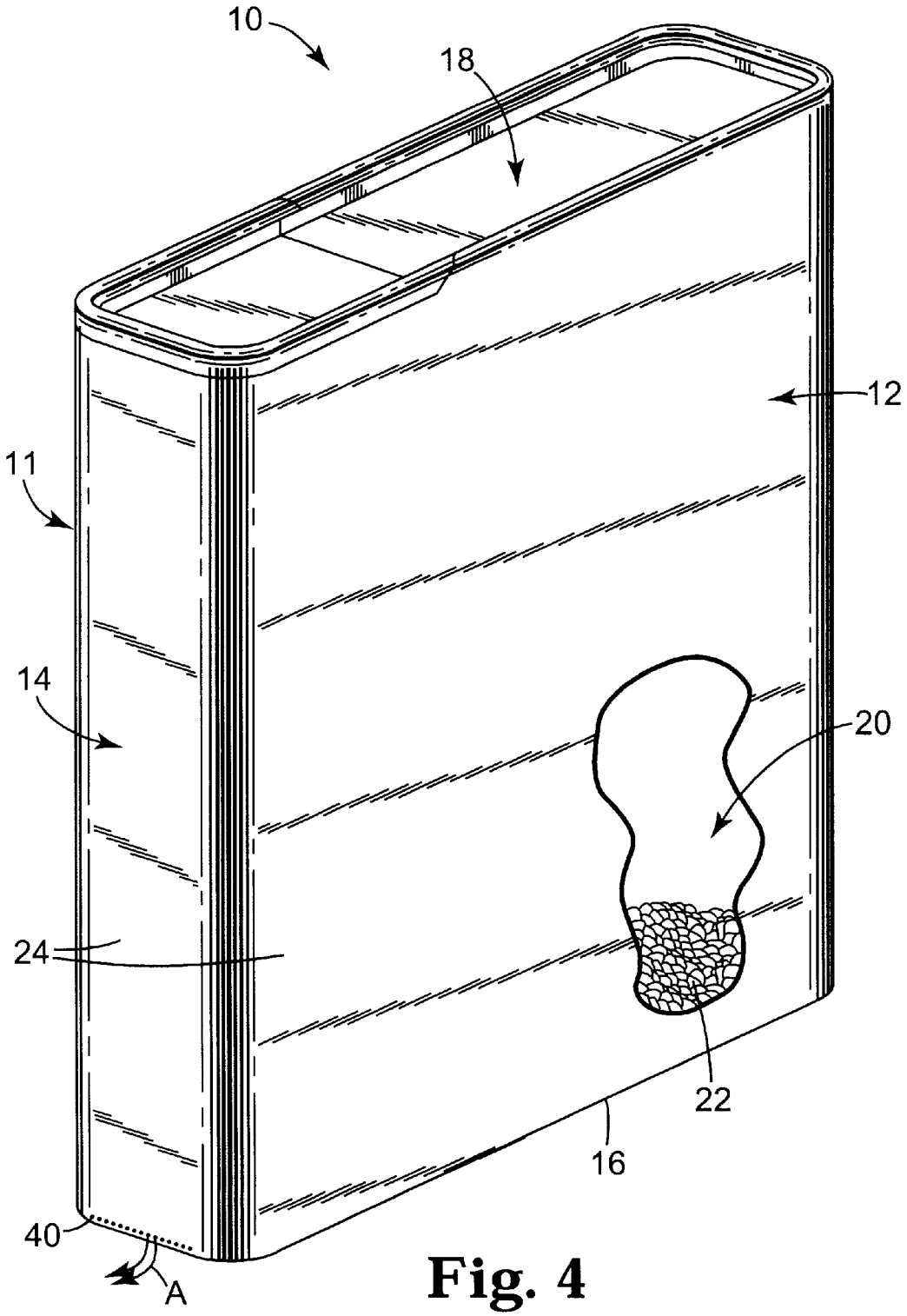
FIG. 4 is a side view of a canister in accordance with the present invention, depicting venting of air.

At some point in the manufacturing process, preferably prior to placement of the particulate-type product 22 within the internal storage region 20 (FIG. 1), the plurality of microholes 40 are formed. For example, in one preferred embodiment, the plurality of microholes 40 are formed in one of the opposing face panels 12 as shown in FIG. 3. Thus, for example, where the tubular body 50, otherwise defined by the opposing face panels 12 and the opposing side panels 14 (FIG. 1), is formed by wrapping a layer of material about a mandrel, the plurality of microholes 40 can be imparted in that layer prior to articulation about the mandrel. Alternatively, or in addition, the plurality of microholes 40 can be formed in one or more of the opposing side panels 14, the bottom panel 16 and/or the top panel 18. As shown in FIG. 4, the plurality of microholes 40 are preferably positioned so as to be at least partially hidden from a consumer, for example near an edge of the canister body 11. Alternatively, the outer surface 24 can include printing that may assist in obscuring the plurality of microholes 40 from view.

An important concern related to the step of creating the plurality of microholes 40 is determining a relatively exact number of microholes required. As described in greater detail below, the plurality of microholes 40 serve to substantially maintain pressure equilibrium of the canister 10. More particularly, the plurality of microholes 40 provide for venting of air from the internal storage region 20 upon a decrease in atmospheric or barometric pressure acting on an exterior of the canister 10. This situation commonly occurs upon shipping of the canister 10 from a low altitude location to a high altitude location. Under these circumstances, the increase in altitude corresponds with a decrease in atmospheric pressure, requiring the venting of air from the internal storage region 20 to maintain integrity of the canister 10. With this in mind, a desired number of the plurality of microholes 40 directly relates to the amount of air within the internal storage region 20, the change in expected altitude and therefore atmospheric pressure, and the rate at which the canister 10 will experience the change in the altitude and therefore atmospheric pressure.

Determining the volume of air maintained within the internal storage region 20 preferably includes estimating a compressed volume of the particulate-type produce 22 in conjunction with an overall volume of the internal storage region 20. In this regard, it is recognized that most products used as the particulate-type product 22 are typically porous and shaped such that spacing between individual particles will occur. For example, where the particulate-type product 22 is a ready-to-eat cereal, the individual cereal particles can be puffed and therefore include air (e.g., puffed rice, wheat, etc.). Additionally, the individual cereal particles typically have non-linear outer surfaces (e.g., flakes, rings, etc.). Thus, while the ready-to-eat cereal may substantially "fill"

the inner storage region 20, a large volume of air remains. In one preferred embodiment, to determine the actual volume of air, the canister 10 is first filled to a normal fill level with the particulate-type product 22. The particulate-type product 22 is then removed from the canister 10 and compressed.

A volume of the resulting compressed product is then compared with an overall volume of the internal storage region 20. The difference between these values approximates a volume of air within the internal storage region under normal production conditions. For example, it has been found that for most ready-to-eat cereal products, air occupies 80–95 percent of a volume of the internal storage region 20.

The expected, maximum decrease in atmospheric pressure value can be ascertained by comparing normal atmospheric pressure at a very low altitude, such as 100 feet, with a relatively high altitude, such as 8,600 feet (the approximate altitude of Loveland, Colorado). Given that the canister 10 will likely be shipped via truck, it can safely be assumed that the canister 10 will not be shipped to a location having an altitude of greater than 8,600 feet. Finally, the rate at which the canister 10 will experience this change in altitude must be determined. Once again, with reference to standard delivery practices, the canister 10 will be shipped by truck. With this in mind, it is likely that under even the most extreme conditions, it will take at least 60 minutes for the canister 10 will travel from a minimum elevation of 100 feet to a maximum elevation 8,600 feet.

With values for volume of air, initial altitude, final altitude and time within which the canister 10 will experience the change in altitude, a determination of the number of microholes can be made. For example, the amount of air that must vent from the canister to prevent expansion can be determined by the following equation:

$$OV=(AV_I \times APX/APM)-AV_I$$

Where

OV=Overflow Volume air to be released $AV_I$=Initial Volume of Air

APX=Maximum atmospheric pressure; and

APM=Minimum atmospheric pressure

The rate at which the air must vent from the internal storage region 20 relates to the amount of air that must escape (or overflow volume) and the time period over which the canister 10 is subjected to the change in altitude. For example, flow rate can be determined by the following equation:

$$FR=OV/T$$

Where:

FR=flow rate (volume/second)

T=time period for change in altitude

Notably, where T is expressed in terms of minutes, it will be necessary to convert the time period to seconds to provide a flow rate in terms of volume/second.

The total cross-sectional area of the plurality of holes 40 can then be determined based upon the above values and a determination of an average pressure differential between atmospheric pressure and pressure of the internal storage region 20. For example, where the canister 10 is shipped by truck from a low elevation to a high elevation, it can be assumed that the canister 10 will experience an average pressure differential of 0.1 psi. Alternatively, an estimation can be made as to the flow rate provided by a certain number of microholes formed at a known diameter. For example, experiments have been performed utilizing microholes having diameters of 70 micrometers. These tests have shown that the flow rate of air in cubic centimeters ($cm^3$) per second through a 70 micrometer hole bears a direct relationship to the pressure differential in psi. For example, with a pressure differential of 0.5 psi, a 70 micrometer hole will vent air at 0.025 $cm^3$ per second; and at 0.1 psi, a 70 micrometer hole will vent air at 0.005 $cm^3$ per second. Thus, 200, 70 micrometer holes will provide a flow rate of 1 $cm^3$ per second at a pressure differential of 0.1 psi. Thus, where the required flow rate is known, multiplying that known value by 200 provides the required number of 70 micrometer holes for adequate venting at a pressure differential of 0.1 psi.

Based upon the above determinations, the following table was generated for various canisters containing 90 percent air traveling from an initial altitude of 100 feet (29.82 inches Hg) to maximum altitude of 8,600 feet (21.32 inches Hg) over the course of 60 minutes:

| Canister Size ($in^3$) | Canister Size ($cm^3$) | Air Volume In Canister ($cm^3$) | Required Overflow ($cm^3$) | Required Flow Rate ($cm^3$/sec) | No. of 70 Micrometer Microholes | Cross-Section Total Area of Microholes ($cm^2$) |
|---|---|---|---|---|---|---|
| 1306 | 21392 | 19253 | 7676 | 2.13 | 426 | 0.01641 |
| 699 | 11450 | 10305 | 4108 | 1.14 | 228 | 0.00878 |
| 662 | 10844 | 9759 | 3891 | 1.08 | 216 | 0.00832 |
| 611 | 10008 | 9007 | 3591 | 1.00 | 200 | 0.00768 |
| 522 | 8550 | 7695 | 3068 | 0.85 | 170 | 0.00656 |
| 485 | 7944 | 7150 | 2851 | 0.79 | 158 | 0.00610 |
| 444 | 7273 | 6545 | 2610 | 0.72 | 145 | 0.00558 |
| 396 | 6486 | 5838 | 2327 | 0.65 | 129 | 0.00498 |
| 375 | 6143 | 5528 | 2204 | 0.61 | 122 | 0.00471 |
| 374 | 6126 | 5514 | 2198 | 0.61 | 122 | 0.00470 |
| 321 | 5258 | 4732 | 1887 | 0.52 | 105 | 0.00403 |
| 346 | 5176 | 4658 | 1857 | 0.52 | 103 | 0.00397 |
| 272 | 4455 | 4010 | 1599 | 0.44 | 89 | 0.00342 |
| 230 | 3767 | 3391 | 1352 | 0.38 | 75 | 0.00289 |
| 222 | 3636 | 3273 | 1305 | 0.36 | 72 | 0.00279 |
| 209 | 3423 | 3081 | 1228 | 0.34 | 68 | 0.00263 |
| 192 | 3145 | 2830 | 1128 | 0.31 | 63 | 0.00241 |
| 164 | 2686 | 2418 | 964 | 0.27 | 54 | 0.00206 |

-continued

| Canister Size ($in^3$) | Canister Size ($cm^3$) | Air Volume In Canister ($cm^3$) | Required Overflow ($cm^3$) | Required Flow Rate ($cm^3$/sec) | No. of 70 Micrometer Microholes | Cross-Section Total Area of Microholes ($cm^2$) |
|---|---|---|---|---|---|---|
| 154 | 2523 | 2270 | 905 | 0.25 | 50 | 0.00194 |
| 150.2 | 2460 | 2214 | 883 | 0.25 | 49 | 0.00189 |
| 143 | 2342 | 2108 | 840 | 0.23 | 47 | 0.00180 |
| 128 | 2097 | 1887 | 752 | 0.21 | 42 | 0.00161 |

The above table sets forth examples of microhole determinations for various canister volumes based upon certain parameters relating to volume of the particulate-type product 22, an initial altitude (and pressure), a final altitude (and pressure) and a time for change in altitude (and pressure). It should be understood, however, that there are many extensions, variations and modifications of the basic themes of the present invention beyond that shown in the table which are within the spirit and scope of the present invention. For example, a diameter other than 70 micrometers can be chosen for the plurality of microholes 40. Further, the selected particulate-type product 22 may have an increased or decreased compressed volume, thereby altering the amount of air maintained within the canister 10. Generally speaking, however, under the most ardent conditions (i.e., a drastic change in altitude), for a canister having an internal storage region volume in the range of approximately 2,000–4,000 $cm^3$ and a particulate-type product having a compressed volume in the range of approximately 200–800 $cm^3$, the plurality of microholes 40 have a total cross-sectional area in the range of approximately 0.001–0.004 $cm^2$. Alternatively, for an internal storage region having a volume in the range of approximately 2,000–4,000 $cm^3$ and a particulate-type product having a compressed volume in the range of approximately 200–800 $cm^3$, approximately 40–100 microholes are provided.

A slight deviation in the exact number of microholes actually formed will likely not result in canister failure. In fact, by forming additional microholes, adequate venting can be ensured. Importantly, however, it is desirable that an overall cross-sectional area of the plurality of microholes 40 not exceed ⅛ inch (0.32 cm).

Upon final assembly, the canister 10 can be shipped from a low elevation to a high elevation without experiencing undue expansion due to changes in atmospheric pressure. As shown in FIG. 4, for example, as the canister 10 is raised from a low altitude to a high altitude, atmospheric pressure acting on an exterior (or outer surface 24) of the canister 10 decreases. A pressure differential develops between atmospheric (or external) pressure and an internal pressure of the internal storage region 20, causing air within the internal storage region 20 to vent from the canister 10 via the plurality of microholes 40, as represented by the arrow A in FIG. 4. With proper venting, the external and internal pressures acting upon the canister 10 remain in substantial equilibrium. Therefore, the canister 10 will not unexpectedly expand or otherwise fail. Further, a series of similarly constructed canisters can be shipped in a corrugated shipping container without concern for potential unpacking problems due to canister expansion at increased elevations.

The canister of the present invention provides a marked improvement over previous designs. The canister includes a hermetically sealable canister body able to maintain the integrity of a contained particulate-type product. Further, by incorporating a plurality of microholes, canister expansion concerns encountered during normal shipping are avoided. In this regard, the requisite number of microholes for adequate venting can accurately be determined for any size canister.

Although the present invention has been described with reference to preferred embodiments, workers skilled in the art will recognize that changes may be made in form and detail without departing from the spirit and scope of the present invention. For example, the canister has been depicted as being generally rectangular in shape. Alternatively, other shapes are equally acceptable. Also, the canister can contain items in addition to the particulate-type product described. For example, a separate coupon or premium can be placed in the canister along with the particulate-type product.

What is claimed is:

1. A canister for containing a particulate product, the canister comprising:

a canister body defining an internal storage region and a product access opening; and a plurality of microholes formed in the canister body away from the product access opening, the plurality of microholes being constructed reduce canister expansion by allowing air flow from the internal storage region due to changes in atmospheric pressure over a time period of at least sixty minutes, the plurality of microholes also being constructed and disposed for limiting passage of the particulate product from the internal storage region;

wherein except for the plurality of microholes, the canister body is constructed for sealing of the internal storage region about the particulate product while said air flow occurs.

2. The canister of claim 1, wherein the canister body has an internal pressure, and further wherein the plurality of microholes are configured such that upon a decrease in atmospheric pressure, a volume of air vents through the plurality of microholes.

3. The canister of claim 1, wherein the plurality of microholes are configured such that air vents from the internal storage region as the canister is raised from a minimum altitude to a maximum altitude of 8,600 feet.

4. The canister of claim 1, wherein the plurality of microholes are sized to minimize passage of contaminants into the internal storage region.

5. The canister of claim 1, wherein the plurality of microholes are uniformly sized.

6. The canister of claim 1, wherein each of the plurality of microholes has a diameter in the range of approximately 10–100 micrometers.

7. The canister of claim 6, wherein each of the plurality of microholes has a diameter of approximately 70 micrometers.

8. The canister of claim 1, wherein a total cross-sectional area of the plurality of microholes is related to a volume of the internal storage region.

9. The canister of claim 8, wherein the total cross-sectional area of the plurality of microholes is further related to a compressed volume of particulate product contained within the internal storage region.

10. The canister of claim 1, wherein the internal storage region has a volume in the range of approximately 2,000–4,000 $cm^3$, the particulate product has a volume in the range of approximately 200–800 $cm^3{}_3$ and the plurality of microholes have a total cross-sectional area in the range of approximately 0.001–0.004 $cm^2$.

11. The canister of claim 10, wherein the internal storage region has a volume of approximately 3,145 $cm^3$, the plurality of microholes have a total cross-sectional area of approximately 0.0024 $cm^2$, and the air flow rate from the internal storage region is about 0.31 $cm^3$/sec.

12. The canister of claim 1, wherein the internal storage region has a volume in the range of approximately 2,000–4,000 $cm^3$, the particulate product has a compressed volume in the range of approximately 200–800 $cm^3$, and the plurality of microholes includes approximately 40–100 microholes.

13. The canister of claim 1, wherein the canister body includes:

opposing face panels;

opposing side panels connected to the opposing face panels to define an upper opening and a lower opening;

a bottom panel connected to the opposing face panels and the opposing side panels so as to encompass the lower opening; and a top panel connected to the opposing face panels and the opposing side panels so as to encompass the lower opening.

14. The canister of claim 13, wherein each of the panels includes a plastic material configured to maintain integrity of product disposed within the internal storage region.

15. The canister of claim 1, wherein the canister is configured to contain a dry food product.

16. The canister of claim 15, wherein the food product is a ready-to-eat cereal.

17. A packaged good article comprising:

a canister including:

a canister body defining an internal storage region and a product access opening, and a plurality of microholes formed in the canister body away from the product access opening, the plurality of microholes being constructed to reduce canister expansion by allowing air flow from the internal storage region due to changes in atmospheric pressure over a time period of at least sixty minutes; and a particulate product disposed within the internal storage region;

wherein each of the plurality of microholes are sized to minimize release of the particulate product, and wherein except for the plurality of microholes, the canister body is constructed for sealing of the internal storage region about the particulate product.

18. The packaged good article of claim 17, wherein the canister body has an internal pressure, and further wherein the plurality of microholes are configured such that upon a decrease in atmospheric pressure, a volume of air vents through the plurality of microholes.

19. The packaged good article of claim 17, wherein the plurality of microholes are configured such that air vents from the internal storage region as the canister is raised from a minimum altitude to a maximum altitude of 8,600 feet.

20. The packaged good article of claim 17, wherein the plurality of microholes are sized to minimize passage of contaminants into the internal storage region.

21. The packaged good article of claim 17, wherein the plurality of microholes are uniformly sized.

22. The packaged good article of claim 17, wherein the each of the plurality of microholes has a diameter of approximately 10–100 micrometers.

23. The packaged good article of claim 22, wherein each of the plurality of microholes has a diameter of approximately 70 micrometers.

24. The packaged good article of claim 17, wherein a total cross-sectional area of the plurality of microholes is related to a volume of the internal storage region.

25. The packaged good article of claim 24, wherein the total cross-sectional area of the plurality of microholes is further related to a volume of air contained within the internal storage region.

26. The packaged good article of claim 17, wherein the internal storage region has a volume in the range of approximately 2,000–4,000 $cm^3$ of which air occupies approximately 80–95 percent, and the plurality of microholes have a total cross-sectional area in the range of approximately 0.001–0.004 $cm^2$.

27. The packaged good article of claim 26, wherein the internal storage region has a volume of approximately 3,145 $cm^3$ and the plurality of microholes have a total cross-sectional area of approximately 0.0024 $cm^2$.

28. The packaged good article of claim 17, wherein the internal storage region has a volume in the range of approximately 2,000–4,000 $cm^3$ of which air occupies approximately 80–95 percent, and the plurality of microholes includes approximately 40–100 microholes.

29. The packaged good article of claim 17, wherein the canister body includes:

opposing face panels;

opposing side panels connected to the opposing face panels to define an upper opening and a lower opening;

a bottom panel connected to the opposing face panels and the opposing side panels so as to encompass the lower opening; and a top panel connected to the opposing face panels and the opposing side panels so as to encompass the lower opening.

30. The packaged good article of claim 29, wherein each of the panels include a plastic material configured to maintain integrity of the particulate product.

31. The packaged good article of claim 17, wherein the particulate product is a dry food product.

32. The packaged good article of claim 31, wherein the food product is a ready-to-eat cereal.

33. A method of manufacturing a packaged good article, the method comprising:

forming a sealable canister having an internal storage region;

imparting a plurality of microholes into the canister, the plurality of microholes extending from an exterior of the canister to the internal storage region; and partially filling the internal storage region with a particulate product, a majority of a remaining volume of the internal storage region being air;

wherein the air within the internal storage region generates an internal pressure, and further wherein upon a decrease in atmospheric pressure, the plurality of microholes allow a volume of air to vent from the internal storage region over a time period of a least sixty minutes and reduce canister expansion.

34. The method of claim 33, wherein imparting a plurality of microholes includes:

determining a volume of air required to be vented from the internal storage region to maintain pressure equilibrium when the packaged good article is raised from a minimum altitude to a maximum altitude; and determining a required number of microholes based upon the volume of air required to be vented.

35. The method of claim 34, wherein determining a required number of microholes further includes:

determining a flow rate of air from the internal storage region required to maintain pressure equilibrium.

36. The method of claim 33, wherein imparting a plurality of microholes includes:

determining a total cross-sectional area of the plurality of microholes required to maintain pressure equilibrium when the packaged good article is raised from a minimum altitude to a maximum altitude;

determining a required number of microholes based upon the total cross-sectional area.

37. The method of claim 33, wherein imparting a plurality of microholes includes:

forming a series of microholes each having a diameter of approximately 70 micrometers.

38. The method of claim 33, wherein forming a hermetically sealable canister includes:

connecting opposing face panels and opposing side panels to form a tubular body having an upper opening and a lower opening;

connecting a top panel to the opposing face panels and the opposing side panels so as to encompass the upper opening; and connecting a bottom panel to the opposing face panels and the opposing side panels so as to encompass the lower opening.

39. The method of claim 38, wherein the internal storage region is partially filled with the particulate product prior to connecting the bottom panel.

40. The method of claim 33, wherein the particulate product is a ready-to-eat cereal.

41. The canister of claim 1, wherein said canister comprises paperboard and plastic; further wherein said canister is free of a bag.

42. The packaged good article of claim 17, wherein said canister comprises paperboard and plastic; further wherein said canister is free of a bag.

43. The method of claim 35, wherein the flow rate of air is determined according to the following equation:

$$FR = OV / T = \frac{((AV_1 \times APX / APM) - AV_1)}{T}, \text{ where}$$

OV=Overflow Volume air to be released $AV_I$=Initial Volume of Air

APX=Maximum Atmospheric Pressure

APM=Minimum Atmospheric Pressure

T=Time Period for Change in altitude.

* * * * *